US005207043A

United States Patent [19]

McGee et al.

[11] Patent Number: 5,207,043

[45] Date of Patent: * May 4, 1993

[54] MASONRY CONNECTOR

[76] Inventors: Brian P. McGee, 176 Wedgewood Drive, Willowdale, Ontario, Canada, M2M 2H9; Frank Rocca, L16 Conc. 8 Doane Road, Box 334, Mt. Albert, Ontario, Canada, L0H 1M0

[ * ] Notice: The portion of the term of this patent subsequent to Jul. 4, 2008 has been disclaimed.

[21] Appl. No.: 268,342

[22] Filed: Nov. 7, 1988

[51] Int. Cl.[5] ..... E04B 1/38

[52] U.S. Cl. ..... 52/379; 52/410; 52/713

[58] Field of Search ..... 52/378, 375, 407, 410, 52/712, 713, 714, 434, 562

[56] References Cited

U.S. PATENT DOCUMENTS

| | | | |
|---|---|---|---|
| 4,473,984 | 10/1984 | Lopez | 52/410 |
| 4,495,741 | 1/1985 | Pasiecznik | 52/410 |
| 4,827,684 | 5/1989 | Allan | 52/714 |

FOREIGN PATENT DOCUMENTS

| | | | |
|---|---|---|---|
| 2131858 | 6/1984 | United Kingdom | 52/714 |

*Primary Examiner*—John E. Murtagh

[57] ABSTRACT

A masonry connector for connecting a structural steel stud and an external wythe of masonry units through interposed insulation is provided. The connector includes a substantially "L"-shaped clip, a high profile threaded screw, a first washer, and a tie wire. The "L"-shaped clip has a vertical arm for connection to the structural steel stud and a horizontal arm extending outwardly from the structural steel stud substantially at right angles to the vertical arm. The vertical arm has a first opening for insertion of the high profile threaded screw. The horizontal arm has a second opening, outwardly of the insulation when the insulation is installed for insertion of a tie wire. The high profile threaded screw is inserted through the first opening in the vertical arm of the clip and drilled through the structural steel stud. The first washer is mounted on the horizontal arm outwardly of the insulation for securing the insulation against the structural steel stud. The tie wire has a first end for insertion through the second opening and a second end for lying in a course of the external wythe. A second rubber washer is installed between the head of the screw and the vertical arm and a third spring steel washer receives the thread of the screw after it is drilled through the structural steel stud.

9 Claims, 3 Drawing Sheets

MASONRY CONNECTOR

FIELD OF THE INVENTION

This invention relates to a masonry connector and, in particular, a masonry connector for connecting an internal wythe and an external wythe of masonry units through interposed insulation.

BACKGROUND OF THE INVENTION

Masonry walls, used in building various structures, often consist of two separate wythes. An external masonry wythe may be a brick wall while an internal wythe may be concrete block or structural steel studs over which is stretched a vapour barrier. The vapour barrier may be drywall coated with rubber or sheet metal. If insulation is used, the insulation is installed between the internal and external wythes and preferably abuts the internal wythe so that an air space exists between the insulation and the external wythe. In constructing masonry walls, it is necessary to connect the internal wythe to the external wythe through the insulation.

Up until this invention, a few connectors have been used to connect an internal wythe and an external masonry wythe. One connector includes a screw having an eyelet head. The screw is drilled through the insulation and screwed into the internal wythe. A tie wire is inserted through the eyelet head and extends along an exterior coursing of the external wythe. A nut, placed on the threaded end of the screw after it is screwed through the steel stud, increases the holding strength of the connector. However, this operation requires that a workman manipulating a screw outwardly of the insulation must accurately locate and hit the stud behind the insulation. This is a not easily accomplished. The nut cannot be applied to the screw if the connector is misaligned, if the thread of the screw is inaccessible, or if the screw has altogether missed the stud. If the nut cannot be used, or if the workman chooses not to use the nut, the tensile strength of anchorage of this connector is not sufficient for connecting many masonry walls.

Other connectors are used to tie masonry veneer walls to metal or wood studs. The tensile strength of anchorage of such connectors, though, is not sufficient for some types of masonry walls.

In addition to connecting the internal wythe to the external wythe, it is advisable to retain the insulation against the internal wythe while the external wythe is being constructed and to permanently space such insulation away from the external wythe to provide for an air gap.

A construction which has been used for this includes a glue pad having a nail projecting from the glue pad. The glue pad is glued to the outer face of the internal wythe and the insulation is poked on to the nail and is held in place by a retaining washer. If the washer does not hold, however, the insulation creeps away from the internal wythe towards the external wythe reducing the air space which should exist between the insulation and the external wythe. Further, the insulation holder and the connector are two separate items requiring separate installation steps.

Thus, a need exists for a masonry connector which can be conveniently and reliably used in constructing an external masonry wall to an internal wythe, such as a structural steel stud, and which holds the insulation in place so that an air space between the insulation and external wythe is maintained. It would be preferable if the connector did not require the user to poke blindly through insulation to hit a steel stud, did not require a separate holder to retain the insulation against the internal wythe, and did not require a nut to achieve sufficient tensile strength of anchorage. Furthermore, the components of the connector should remain integral over the life span of the building so that the connector could be confidently used in masonry construction.

SUMMARY OF THE INVENTION

A masonry connector for connecting an internal wythe and an external wythe of masonry units through interposed insulation is provided. In one aspect of the invention, the connector includes a substantially "L"-shaped clip, attachment means, a first washer, and a tie wire. The "L"-shaped clip has a vertical arm for connection to the internal wythe and a horizontal arm extending outwardly from the internal wythe substantially at right angles to the vertical arm. The vertical arm has a first opening for insertion of the attachment means. The horizontal arm has a second opening outwardly of the insulation when the insulation is installed for insertion of a tie wire. The attachment means is inserted through the first opening to connect the vertical arm of the clip to the internal wythe. The first washer is mounted on the horizontal arm outwardly of the insulation for positioning the insulation inwardly of the external wythe. This provides an air space between the insulation and the external wythe. The tie wire has a first end for insertion through the second opening and a second end for lying in a course of the external wythe.

In one aspect of the invention, the internal wythe is a steel stud over which is stretched a vapour barrier.

In another aspect of the invention, the horizontal arm may include means for retaining the first washer on the horizontal arm. Projections rising above the surface of the horizontal arm may be provided as the retaining means.

In another aspect of the invention, the attachment means is a high profile screw. In this document, "high profile screw" means that the screw has a high threaded profile. The high profile screw may be coated with a corrosion-resistant coating, such as a copolymer of suspended aluminium particles.

The connector may also include means for maintaining the vertical arm of the clip substantially perpendicular to the horizontal arm of the clip. The maintaining means, such as ribs, may be attached to the horizontal arm and the vertical arm.

The components of the masonry connector may be made of corrosion-resistant metal, such as stainless steel. A second washer may be provided between the head of the high profile screw and the vertical arm. A third washer may be provided to receive the thread of the high profile screw after it is drilled through the internal wythe.

In another aspect of the invention, a wall having insulation interposed between an internal wythe and an external wythe of masonry units is provided. The insulation and the masonry units may be connected by the masonry connector described above. The internal wythe may be a steel stud over which is stretched a vapour barrier. The vapour barrier may be drywall coated with rubber or sheet metal. The connection of the masonry connector to the steel stud has a tensile strength of at least 700 pounds.

In another aspect of the invention, a method of connecting an internal wythe and an external wythe of masonry units through interposed insulation is provided. The method includes providing a substantially "L"-shaped clip having a vertical arm for connection to the internal wythe and a horizontal arm extending outwardly from the internal wythe substantially at right angles to the vertical arm. The vertical arm has a first opening for insertion of attachment means and the horizontal arm has a second opening outwardly of the insulation when the insulation is in its installed position for insertion of a tie wire. Attachment means is inserted through the first opening to connect the vertical arm of the clip to the internal wythe. A first washer is mounted on the horizontal arm outwardly of the insulation for positioning the insulation inwardly of the external wythe. A first end of a tie wire is inserted through the second opening and a second end of the tie wire is laid in a course of the external wythe.

DRAWINGS

The drawings illustrate embodiments of the invention, in which.

Figure 3:
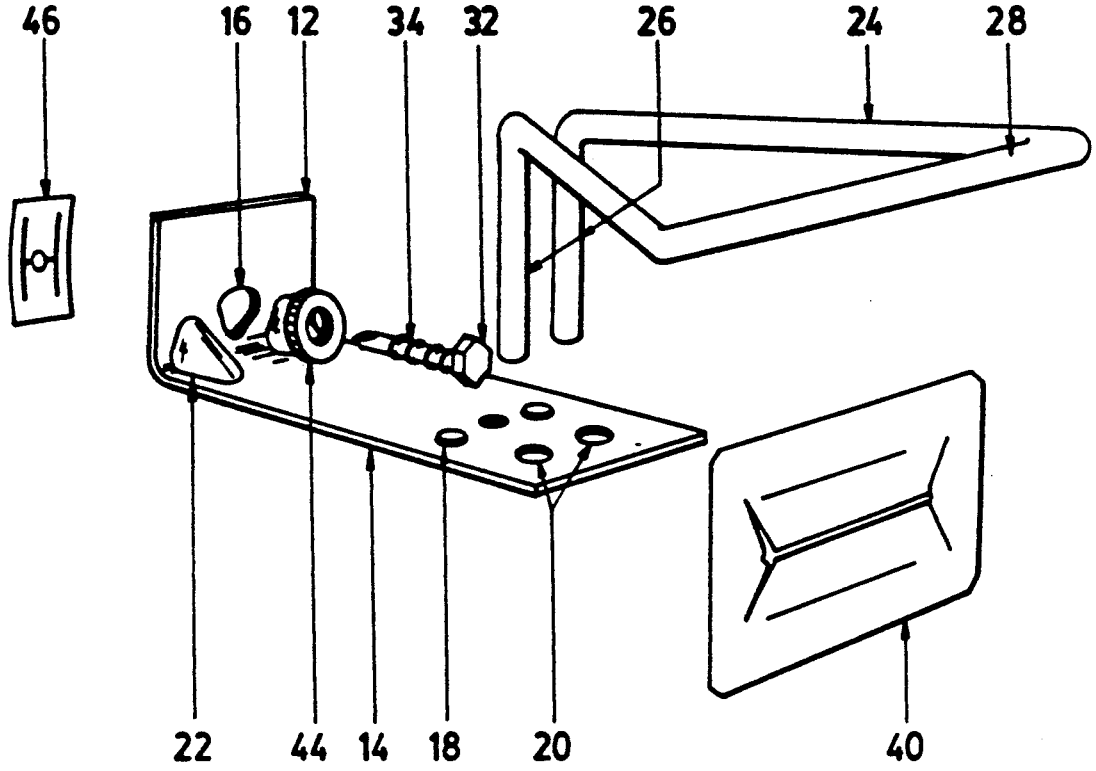

FIG. 3 an exploded view of the components of the masonry connector; and

Figure 4:
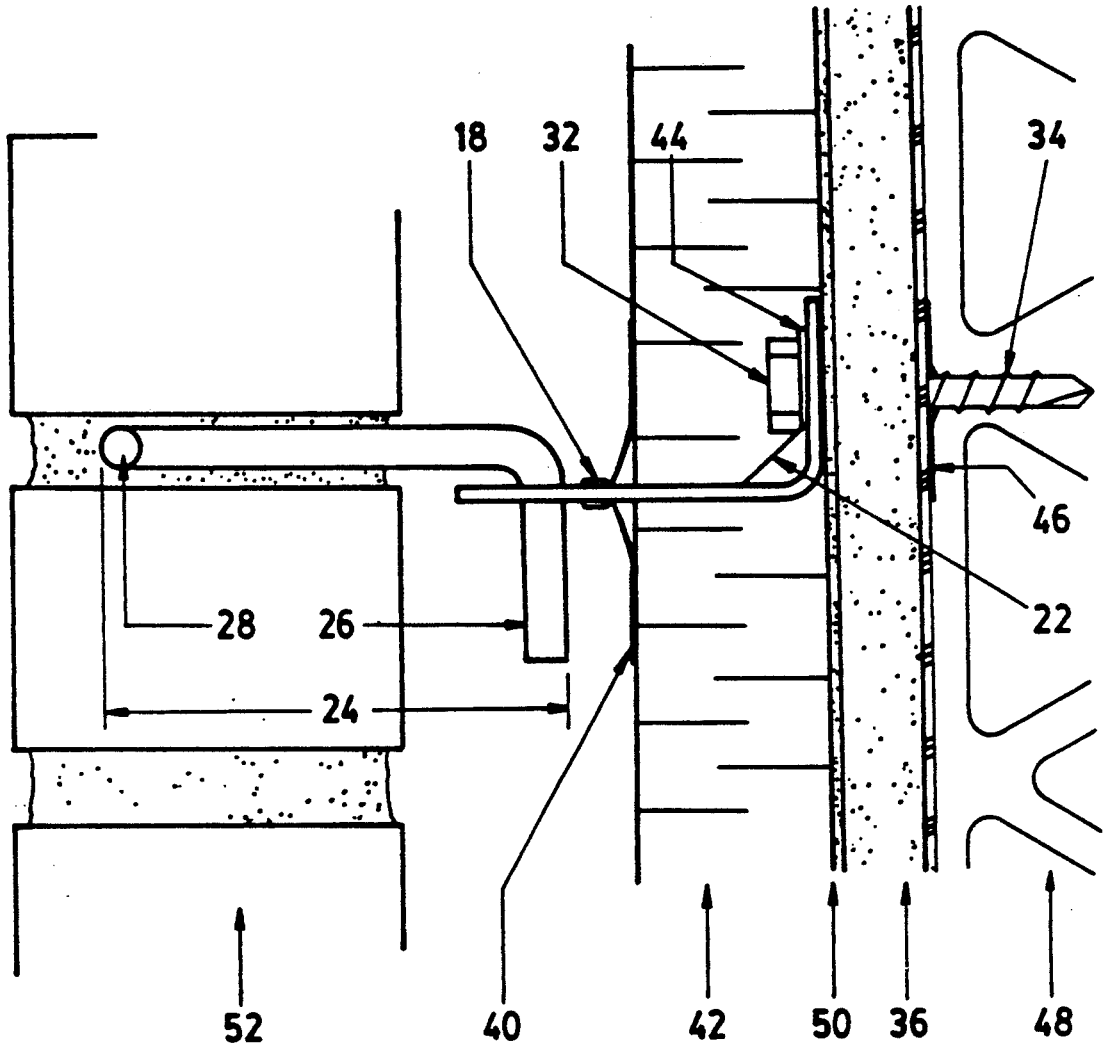

FIG. 4 is a side elevation view of the masonry connector.

DETAILED DESCRIPTION OF THE PREFERRED EMBODIMENT

| Numeral | Description of Part |
|---|---|
| 10 | "L"-shaped clip |
| 12 | Vertical arm of "L"-shaped clip |
| 14 | Horizontal arm of "L"-shaped clip |
| 16 | Opening in vertical arm 12 |
| 18 | Raised projections on "L"-shaped clip to hold insulation washer 40 |
| 20 | Opening in horizontal arm 14 |
| 22 | Two ribs to reinforce right angle of "L"-shaped clip |
| 24 | Tie wire |
| 26 | One end of tie wire secured to "L"-shaped clip 10 |
| 28 | One end of tie wire secured to external wythe 52 |
| 32 | Head of screw |
| 34 | Threaded portion of screw |
| 36 | Drywall skin |
| 40 | Insulation retaining washer (first washer) |
| 42 | Insulation |
| 44 | Rubber washer (second washer) |
| 46 | Spring steel washer (third washer) |
| 48 | Structural steel stud |
| 50 | External face of drywall skin 36 or sheet metal 38 |
| 52 | External wythe - masonry units |

Figure 1:
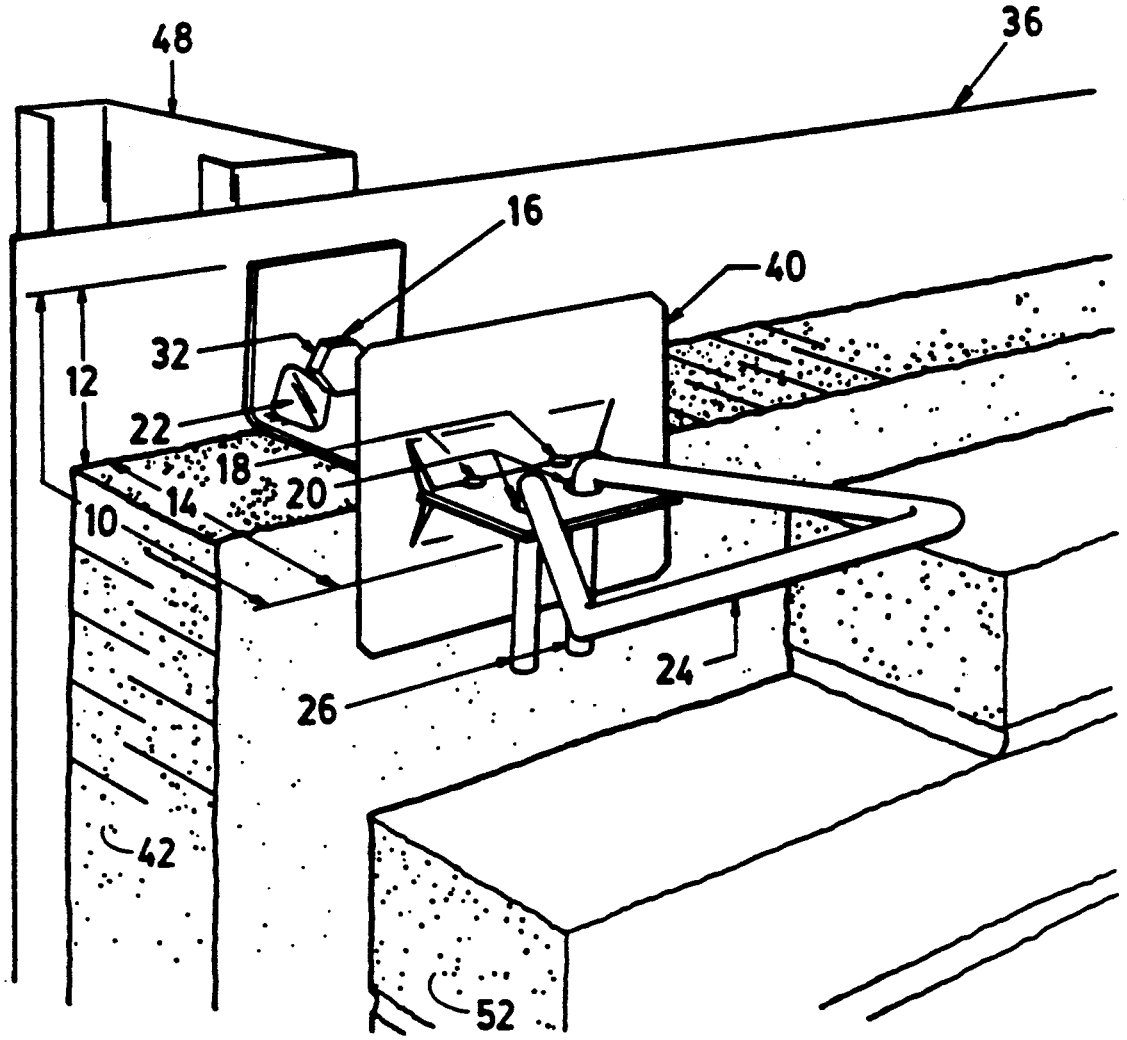
FIG. 1 is a perspective view of a masonry connector connecting an internal wythe and an external wythe of masonry units through interposed insulation.

FIG. 1 generally illustrates the components of this masonry connector. The connector connects a structural steel stud 48 and an external wythe 52 and secures insulation 42. The structural steel stud 48 may be covered with drywall 36 while the external wythe 52 may be brick. Rather than drywall 36, sheet metal may be used. The connector includes an "L"-shaped clip 10 having a vertical arm 12 and a horizontal arm 14. The vertical arm 12 has a first opening 16 preferably located no more than one-quarter inch from the horizontal arm 14 of the clip 10. The vertical arm 12 is perpendicular to the horizontal arm 14 and defines a right angle. The first opening 16 is located between two high ribs 22 which maintain the right angle of the "L"-shaped clip 10. Each rib 22 is joined to the vertical arm 12 and the horizontal arm 14. The horizontal arm 14 of the "L"-shaped clip 10 has a second opening 20. The horizontal arm 14 also has projections 18 inwardly of the second opening 20 and outwardly of the insulation 42 when the insulation 42 is installed. These projections 18 preferably rise 30/1000" above the surface of the horizontal arm 14. The connector also includes a high profile screw having a head 32 and a thread 34. A rubber washer 44 is inserted between the head 32 of the screw and the vertical arm 12 of "L"-shaped clip 10.

An insulation retaining washer 40 is mounted on the horizontal arm 14 of the "L"-shaped clip 10 and secures the insulation 42 against the drywall 36. Projections 18 on the horizontal arm 14 are 30/1000" above the surface of the horizontal arm 14 and retain the washer 40 on the horizontal arm 14 of the "L"-shaped clip 10.

Figure 2:
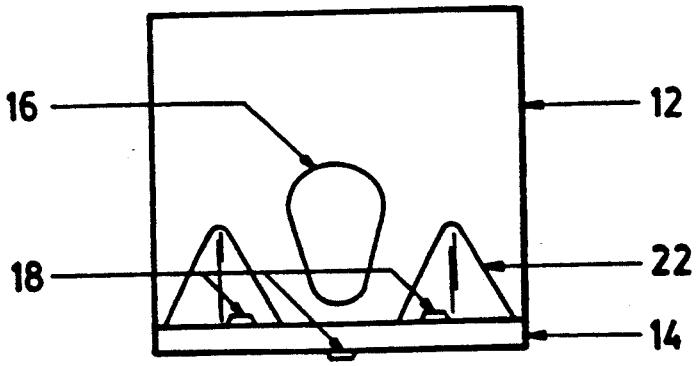
FIG. 2 is a front elevation view of the masonry connector.

FIG. 2, an elevation view of the connector, shows how projections 18 retain washer 40 against the insulation 42. The washer 40 is mounted on horizontal arm 14 and passes over projections 18. [Tie wire 24 would not yet be installed.] The washer 40 then springs back against the projections 18 being wedged between the insulation 42 and the projections 18. In this way, movement of the washer 40 and the insulation 42 away from the drywall 36 is prevented.

A spring steel washer 46 is pressed against the inside face of the structural steel stud 48 and receives the thread 34 of the screw after it is inserted through the first opening 16 and screwed through the drywall 36 and structural steel stud 48. The spring steel washer 46 is approximately $\frac{1}{2}'' \times \frac{1}{4}''$. It is installed to provide additional holding power should deterioration occur in the structural steel stud 48 at the penetration point.

A tie wire 24 has one end 26 for insertion through the second opening 20 and another end 26 to lie in the course of the external wythe 52.

The components of the connector may be made of stainless steel so that the connector remains integral over the life span of the building.

In use, the vertical arm 12 of the L-shaped clip 10 is pressed against the face of drywall 36. A high profile screw having a rubber washer 44 is inserted through the first opening 16 in the vertical arm 12. The high profile screw is then screwed through the drywall 36 and through the structural steel stud 48. The screw thus connects vertical arm 12 to the steel stud 48. The insulation 42 is then positioned against the external face 50. An insulation retaining washer 40 is mounted on horizontal arm 14 and is pressed over projections 18. Insulation 42 forces washer 40 to spring back against projections 18. Thus, the insulation retaining washer 40 is wedged between insulation 42 and projections 18. One end 26 of an S-shaped tie 24 is inserted through a second opening 20 in the horizontal arm 14 of the L-shaped clip 10. The other end 28 of the tie 24 lies in the coursing of the external wythe 52.

The connection of the connector to the masonry units has a tensile strength of at least 700 lbs.

MATERIALS

The high profile screw can be purchased from Buildex having description of $\frac{1}{4} \times 10$ or $\frac{1}{4} \times 14$. The rubber washer 44 has been designed for use with the high profile screw to prevent air transfer from the interior to the exterior of the building. The "L"-shaped clip 10 is composed of type 304 stainless steel. Insulation retaining washer is also of type 304 stainless steel. The screw is coated with a corrosion resistant coating, namely, a copolymer of suspended aluminum particles (CLIMA-SEAL TM). Other components of the connector are readily available as is known to those skilled in the art.

While preferred embodiments have been described in detail, it will be understood by those skilled in the art that variations may be made to embodiments without departing from the spirit or scope of the appended claims.

What is claimed is:

1. A masonry connector for connecting an internal wythe to an external wythe of masonry units thorugh interposed insulation, comprising:

a substantially "L"-shaped clip, having a vertical arm for connection to the internal wythe and a horizontal arm extending outwardly from the internal wythe substantially at right angles to the vertical arm, the vertical arm having a first opening for insertion of attachment means and the horizontal arm having a second opening outwardly of the insulation when the insulation is installed for insertion of a tie wire;

attachment means for insertion through the first opening to connect the vertical arm of the clip to the internal wythe;

a first washer for mounting on the horizontal arm outwardly of the insulation for positioning the insulation inwardly of the external wythe;

a tie wire having a first end for insertion through the second opening and a second end for lying in a course of the external wythe;

wherein the horizontal arm includes projections rising 30/1000" above the surface thereof.

2. A masonry connector as set forth in claim 1 further comprising a second washer for insertion between the head of the high profile screw and the vertical arm of the "L"-shaped clip.

3. A masonry connector as set forth in claim 1 further comprising a third washer for receiving the thread of the high profile screw after it is screwed thorugh the internal wythe.

4. A wall having insulation interposed between an internal wythe and an external wythe of masonry units, the insulation and the masonry units being connected by a masonry connector of claim 1 and wherein the internal wythe is a steel stud over which is stretched a vapour barrier.

5. A wall set forth in claim 4 wherein the connection of the masonry connector to the steel stud has tensile strength of at least 700 lbs.

6. A masonry connector for connecting an internal wythe and an external wythe of masonry units through interposed insulation, comprising:

(a) a substantially "L"-shaped clip, having a vertical arm for connection to the internal wythe and a horizontal arm extending outwardly from the internal wythe substantially at right angles to the vertical arm, the vertical arm having a first opening for insertion of a high profile screw, the horizontal arm having a second opening outwardly of the insulation when the insulation is installed for insertion of a tie wire, and the horizontal arm having projections on its surface inwardly of the second opening;

(b) ribs attached to the horizontal arm and the vertical arm for maintaining the vertical arm of the clip substantially perpendicular to the horizontal arm of the clip;

(c) a high profile screw coated with corrosion resistant coating for insertion through the first opening to connect the vertical arm of the clip to the internal wythe;

(d) a first washer for mounting on the horizontal arm outwardly of the insulation for positioning the insulation inwardly of the external wythe, the projections on the horizontal arm retaining the first washer on the horizontal arm inwardly of the second opening when the insulation is installed;

(e) a second rubber washer for positioning between the head of the high profile screw and the vertical arm of the "L"-shaped clip;

(f) a third washer for receiving the thread of the high profile screw after it is drilled through the internal wythe;

(g) a tie wire having a first end for insertion through the second opening and a second end for lying in a course of the external wythe;

wherein the components of the masonry connector are made of corrosion-resistant metal.

7. A masonry connector as set forth in claim 6 wherein the internal wythe is a steel stud.

8. A wall having insulation interposed between an internal wythe and an external wythe of masonry units, the insulation and the masonry units being connected by the masonry connector of claim 6.

9. A wall as set forth in claim 7 wherein the connection of the masonry connector to the steel stud has a tensile strength of at least 700 lbs.

* * * * *